US005863042A

United States Patent [19]

Lo

[11] Patent Number: 5,863,042

[45] Date of Patent: Jan. 26, 1999

[54] CARD GAME

[76] Inventor: Henry T. Lo, 1647 S. 17th St., Philadelphia, Pa. 19145

[21] Appl. No.: 847,173

[22] Filed: May 1, 1997

Related U.S. Application Data

[60] Provisional application No. 60/016,706 May 2, 1996 and provisional application No. 60/017,418 May 8, 1996 and provisional application No. 60/017,920 May 16, 1996 and provisional application No. 60/022,278 Jul. 23, 1996 and provisional application No. 60/025,324 Sep. 6, 1996 and provisional application No. 60/026,628 Sep. 24, 1996 and provisional application No. 60/034,906 Jan. 7, 1997 and provisional application No. 60/040,141 Mar 7, 1997.

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS

| | | | |
|---|---|---|---|
| 4,659,087 | 4/1987 | Shen et al. | 273/274 |
| 5,288,082 | 2/1994 | Marquez | 273/292 |
| 5,411,268 | 5/1995 | Nelson et al. | 273/292 |
| 5,678,821 | 10/1997 | Hedman | 273/292 |

OTHER PUBLICATIONS

"Pai Gow Poker" by Linya Quan, WIN magazine, pp. 39, 40, 70, Apr. 1992.

"9's Up Harrah's Gaming Guide", Harrah's Lake Tahoe Resort Casino, 1988.

*Primary Examiner*—Benjamin H. Layno

*Attorney, Agent, or Firm*—Elman & Associates

[57] ABSTRACT

The card game of the present invention uses a standard fifty-two card poker deck. Each Player is dealt four or preferably five cards, and plays against a Banker. There is a primary wager and independent secondary wagers. In the primary wager, four-of-a-kind is an automatic winner for the Player. If the Player does not have four-of-a-kind, the Player splits the dealt cards into a high hand and a low hand. The low hand must not rank higher than the high hand, or it is a foul and the Player loses. The Player's low hand and the Banker's low hand are compared, and the Player's high hand and the Banker's high hand are compared. The Player wins if both hands win, loses if both lose, and ties in the event of a split. Hands are ranked three of a kind (for the five card version), pair, and point value. A higher ranked three-of-a-kind beats a lower ranked three-of-a-kind; a higher ranked pair beats a lower ranked pair; a higher point value beats a lower point value. Point value is calculated by adding the sum of the non-matched cards, and looking to the right-most digit. For example, 654 adds to 15 for a "point value" 5. Face cards count 10 or 0, and Aces count 11 or 1. The Banker wins ties in pairs. Ties in Point value are broken as follows: in a low hand point value of 0 to 4, Banker wins tie. In other point value ties, the hand with the highest ranking card wins, the Banker winning highest card ties. Setting the dealt hand in the primary wager requires some skill. The Secondary Wager or Side Bet does not require skill; Players win their wagers based on the strength of the hands as dealt.

22 Claims, 6 Drawing Sheets

601

| PP4 POKER "HOUSE-WAY CHART" |
| --- |
| Four of a Kind: declare as "Pair Pair 4" |
| Full House: 3 of a Kind in hh (high hand) a Pair in lh (low hand) |
| Three of a Kind: 3 of a Kind in hh except splitting<br>(a) "222", "333" or "444" -- minimum 7 & +4 in lh<br>(b) "555", "666", or "777" -- minimum 6 & +3 in lh<br>(c) "888" -- minimum 7 & +2 in lh<br>(d) "999" -- just +2 in lh<br>(e) "10 10 10" to "AAA" just +1 to lh |
| Two Pair: high pair in hh & low pair in lh |
| One Pair: pair in hh, except splitting<br>(a) "22", "33", "44", "55" or "77" minimum 8 and +2 in lh<br>(b) "66" -- minimum 6 & +3 in lh, and a 9 in hh<br>(c) "88" -- 88 with 3 of 5 high cards: A, K, Q, J and 10<br>(d) "99" 00 99 with 3 of 4 face cards: K, Q, J, and 10<br>NOTE: Never split "10 10" though "AA" |
| 5 Unmatched cards:<br>(a) Make the hh total 9 if it is an A-high, K-high, or Q-high 9 otherwise set lh as high as possible<br>(b) Highest card -- if lh is 0 - 4 or hh is a 9, it is put in hh, otherwise it is put in lh |

Fig. 6

CARD GAME

A portion of the disclosure of this patent document contains material which is subject to copyright protection. The copyright owner has no objection to the facsimile reproduction by anyone of the patent disclosure, as it appears in the PTO patent file or records, but otherwise reserves all copyright rights whatsoever.

CROSS REFERENCE TO RELATED APPLICATIONS

This application claims priority under 35 U.S.C. § 119(e) from the following U.S. provisional patent applications: provisional patent application Ser. No. 60/016,706 filed May 2, 1996; provisional patent application Ser. No. 60/017,418 filed May 8, 1996; provisional patent application Ser. No. 60/017,920 filed May 16, 1996; provisional patent application Ser. No. 60/022,278 filed Jul. 23, 1996; provisional patent application Ser. No. 60/025,324 filed Sep. 6, 1996; provisional patent application Ser. No. 60/026,628 filed Sep. 24, 1996; provisional patent application Ser. No. 60/034,906 filed Jan. 7, 1997; and provisional patent application Ser. No. 60/040,041 filed Mar. 7, 1997, all of which are incorporated by reference.

FIELD OF THE INVENTION

The present invention generally relates to card games and, in particular, to card games for use in casinos and cardrooms.

SUMMARY OF THE INVENTION

The present invention provides a five-card game in the poker family played with at least one but preferably one standard poker deck of fifty-two cards. Each Player, one of whom is the Banker against whom the other Players play, is dealt four or preferably five cards. The Players may place a Primary Wager and/or one or more Secondary Wagers before the cards are dealt. An embodiment of the present invention is offered under the trademark PAIR PAIR 4, wherein the Primary Wager is known as "PP4 Poker" and the Secondary Wagers as "PP4 Side Bets."

For the Primary Wager, the dealt hand is arranged by a Player into two separate hands. In the five-card embodiment, each Player arranges the dealt hand into a three-card "high hand" and a lower ranking two-card "low hand" each of which must beat the Banker's respective hands in order for the Player to win. The ranking of the hands is similar to poker ranking: three-of-a-kind beats a pair; a higher ranked pair beats a lower ranked pair; and a pair beats a "point hand" (a hand without any pair).

A hand that does not contain at least a pair is called a "point hand." The numerical value of the cards in the hand is added up, and the right-most digit is the "point value" of the hand. The hand with the higher point value is the winner. For example, a low hand consisting of the cards 8 and 9 add to 17, yielding a point value of 7. This hand would lose to a low hand consisting of the cards 9 and 10 which add to 19 and yield a point value of 9. "Face cards" (Jacks, Queens, and Kings) count 10 or 0, and Aces count 11 or 1. "Point value" tics are a special case explained in further detail in the Description of Preferred Embodiments.

Secondary Wagers allow Players to bet on the contents of their dealt hand. They are evaluated independently of the outcome of the Primary Wager. For example, in "One Pair Bet" the Player bets that his hand contains at least one pair. There are "Two Pair," "Three-of-a-kind," and "Special" Side Bets explained in further detail in the Description of the Preferred Embodiments.

A four-card embodiment of the game of the present invention in which the four-card hand is split into a two-card high hand and a two-card low hand is discussed herein.

The card game of the present invention provides some familiar elements of traditional poker, in that it is played with a conventional deck of fifty-two cards. In the game of the present invention, the dealt hand is split into two smaller hands. The split of a dealt hand is similar to some Pai Gow tile games, some of which deal four tiles to a Player. In contrast to Pai Gow, a preferred embodiment of the present invention uses five poker cards, allows three-of-a-kind combinations in the high hand, and has other difference mentioned herein. "Point" hand values are computed using elements similar to those found in Baccarat. However, "point" ties are broken according to the rules outlined herein, in contrast to Baccarat. Pai Gow Poker uses fifty-three cards, including a joker, deals a seven card hand, and includes all of the traditional poker hands as ranking hands. The game of the present invention is simpler than Pai Gow, plays faster, and allows more discretion in how a Player sets a particular dealt hand. It is an advantage of the present invention that the Primary Wager is fun and easy to play using familiar elements of poker, though with some additions and subtractions which make the game unique. It is an advantage of the present invention that the Secondary Wagers resemble slot machine payoff: skill is not required for a return. It is an advantage of the present invention that the game is not intimidating to play and simple enough to be learned by new Players. It is an advantage of the present invention to create an embodiment which can be a casino game in which a there is a nonadversarial, social atmosphere. It is a feature of the present invention to provide a cardroom game which may be played against a non-house Banker.

BRIEF DESCRIPTION OF THE DRAWINGS

The present invention, both as to its organization and its manner of operation, together with further objects ad advantages, may be best understood by reference to the following description, in connection with the accompanying drawings.

FIG. 6 shows a "house way" chart.

DESCRIPTION OF PREFERRED EMBODIMENTS

Figure 1:
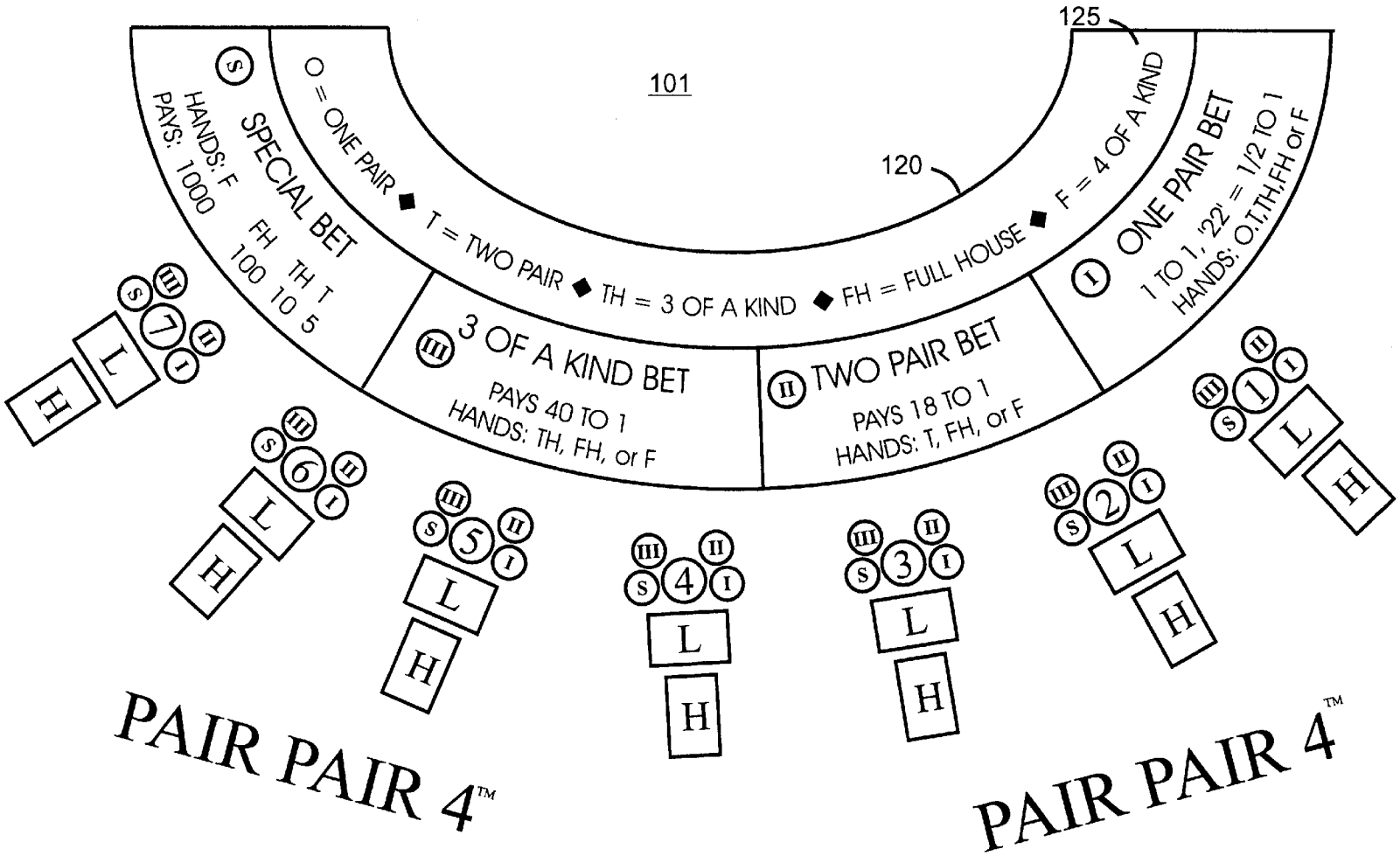
FIG. 1 shows a preferred layout of a casino card table of the present invention.

A preferred embodiment of the present invention provides a five-card game played with one standard poker deck of fifty-two cards and no joker. Other embodiments contemplate a version which would be played with at least one standard poker deck. Each Player and the Banker is dealt five cards. There is a Primary Wager and/or one or more Secondary Wagers. Wagers are placed by a Player before the cards are dealt. The primary and Secondary Wagers are evaluated independently of the outcome of each other. A Player may win the Primary Wager but lose a Secondary Wager. A Player may win the Secondary Wager and lose the Primary Wager. A player may win both wagers or lose both wagers.

An embodiment of the present invention is offered under the trademark PAIR PAIR 4, wherein the Primary Wager is known as "PP4 Poker" and the Secondary Wagers as "PP4 Side Bets."

A alternative embodiment uses a dealt hand of four cards instead of five, and is discussed in a later section of the application.

PRIMARY WAGER

Once the cards have been dealt, all Players and the Banker review their dealt hands for four-of-a-kind. If the Banker has four-of-a-kind the Primary Wager is over for all Players. All Players who do not also have four-of-a-kind lose, and all Players who also have four-of-a-kind win the Primary Wager. If but a single Player has four-of-a-kind, that Player wins the Primary Wager, and Primary Wager play continues for the other Players.

The four-of-a-kind winner rule is designed to allow Players to have a winning Primary Wager if they have the strong poker hand four-of-a-kind. Absent this rule, a strong dealt hand like 2222A would likely tie or even lose to a Banker's much weaker dealt hand. For example, the aforementioned deal hand is split into a 22A high hand and 22 low hand which together would "push" a Banker's 33A high hand and 54 low hand. The 2222A dealt hand would lose to any Two Pair hand, for example 44A high hand and 33 low hand. These outcomes are less fun for Players than the preferred four-of-a-kind rule.

In a preferred embodiment of the present invention, four-of-a-kind is known as "Pair Pair 4."

Assuming the Banker does not have four-of-a-kind in the dealt hand, the five cards are arranged by a Player into two separate hands. The cards are set into a three-card high hand and two-card low hand.

If the Player sets a low hand which ranks higher than his high hand, that is considered a foul and the Player loses the Primary Wager. In casino play, if the Banker sets a higher ranked lower hand, the Banker must reset the hand so that it is not a foul. Cardroom play may or may not allow the non-house Banker to reset the hand according to the particular house rules.

In order for the Player to win, the Player's low hand must beat the Banker's low hand, and the Player's high hand must beat the Banker's high hand. In order for a Player to lose, the Player's low hand must lose to the Banker's low hand, and the Player's high hand must lose to the Banker's high hand. If the Banker wins one hand and loses the other, it is a push or tie and the wager is neither won nor lost and the bet is returned to the Player.

After the deal, all of the Players must set their hands by placing their low hand in the appropriate spot on the playing surface and their high hand in appropriate spot on the playing surface. The Players may not touch their cards once the dealer has told them the Banker is ready to reveal his cards.

In the game of the present invention, the ranking of the hands is similar to poker ranking: but neither straights (cards in numeric sequence), flushes (all cards of the same suit), nor straight flushes (all cards of same suit in numeric sequence) are ranking hands in the preferred embodiment of the game. Three-of-a-kind beats a pair which in turn beats a "point hand" (a hand without any pair).

In the preferred embodiment, cards are ranked from Ace (highest) through 2 (lowest). A higher ranked three-of-a-kind beats a lower ranked three-of-a-kind (i.e. three Kings beats three Queens, and a higher ranked pair beats a lower ranked pair (i.e. a pair of fours beats a pair of deuces).

A notable distinction between the present game and poker is that 445 and 446 tie. In the game of the present invention, the third card in a high hand is ignored when comparing high hands that consist of pairs of the same value. For example, if the Banker had 445 and the Player had 446, the Player's high hand loses. Similarly, if the Player has AA and the Banker also has AA, the Player's low hand loses. This is a "copy hand" rule.

Hands that do not contain at least a pair are called "point hands." The numerical value of the cards in the hand is added up, and the right-most digit is called the "point value" of the hand. The hand with the higher point value is the winner. For example, a low hand consisting of the cards 8 and 9 add to 17, yielding a point value of 7. This hand would lose to a hand consisting of the cards 4 and 5 which add to 9 and yield a point value of 9. A hand of 10, 8 and 2 adds to 20 and yields a "point value" of 0. Cards are valued at their numerical value, with "face cards" (Jacks, Queens, and Kings) worth 0 or 10, and Aces at 1 or 11. The calculation of "point value" is similar to the calculation used in Baccarat.

Hands are ranked in the following order, from high to low:

| | |
|---|---|
| 1. | AAA |
| 2. | KKK |
| 3. | QQQ |
| 4. | JJJ |
| 5. | 10 10 10 |
| 6. | 999 |
| 7. | 888 |
| 8. | 777 |
| 9. | 666 |
| 10. | 555 |
| 11. | 444 |
| 12. | 333 |
| 13. | 222 |
| 14. | AA |
| 15. | KK |
| 16. | QQ |
| 17. | JJ |
| 18. | 10 10 |
| 19. | 99 |
| 20. | 88 |
| 21. | 77 |
| 22. | 66 |
| 23. | 55 |
| 24. | 44 |
| 25. | 33 |
| 26. | 22 |
| 27. | Point Value 9 |
| 28. | Point Value 8 |
| 29. | Point Value 7 |
| 30. | Point Value 6 |
| 31. | Point Value 5 |
| 32. | Point Value 4 |
| 33. | Point Value 3 |
| 34. | Point Value 2 |
| 35. | Point Value 1 |
| 36. | Point Value 0 |

"Point value" ties are a special case. Unlike Baccarat, a point value tie is not an automatic "push." In the case where two "point hands" tie, there are two scenarios: "plain point" comparison and "highest card" comparison. A "plain point" comparison is one in which the point value of the low hands is between 0 and 4. If the "plain point" is a tie, the Player loses to the Banker. For example, the Player's Ace Three ("plain point" 4) loses to the Banker's Ten Four ("plain point" 4). This is a "copy hand" rule.

When both high hands of three cards are tie "point hands" or when the low hands are not a "plain point" tie (i.e. the low hands have a "point value" of 5 through 9), a "highest card" comparison is required. The highest card from each point hand is compared, and the hand having a higher card is the winner. For example, an Ace Five point value "6" beats a King Six point value "6" because the Ace beats the King in the "highest card" comparison.

For example, if the Player has low hand A5 and the Banker has low hand A5, the Banker's hand wins the highest card comparison. It is important to note that only the highest card is compared in "highest card" comparison. This is different from how traditional poker hands are ranked. If the Player's high hand is a K7 2 for a King-high "point value" 9, and the Banker's hand is a K6 3 for a King-high "point value" 9, the hands tie and the Player loses to the Banker. This is true because only the King's are compared without resort to a comparison of the second highest cards 7 and 6. This is a "copy hand" rule. In contrast, in poker K72 would beat K63.

Banker's advantages include the following "copy rules" to enhance the house advantage (or encourage Players to be the Banker in a cardroom game): (a) Player and Banker have same pair (e.g. Banker's 44J beats Player's 44K; Banker's 66 beats Player's 66); (b) same "highest-card point" (e.g. Banker's 45K beats Player's 36K; Banker's A5 beats Player's A5); and (c) same "plain point" (Banker's J3 beats Player's A2).

In cardroom play, the house may receive money from each Player each hand, it may receive money from the winner of each hand, it may receive no money except from Players on an hourly basis, or it may be remunerated by other means commonly used in cardroom play.

In cardroom play, it is preferred that each Player be allowed one turn at a time as Banker, although no Player is forced to be the Banker. Secondary Wagers (as discussed herein) may be eliminated. Secondary Wagers may be limited to Single Pair Side Bets in the preferred embodiment of the cardroom game.

In Primary Wager play, a Player beats the Banker when the Player's low hand beats the Banker's low hand and the Player's high hand also beats the Banker's high hand. The Player loses when the Banker's low hand beats the Player's low hand and the Banker's high hand also beats the Player's high hand. If one wins one hand and loses the other hand it is a tie, also known as a "push."

The Primary Wager is designed to be quick to play, fun, different enough from poker to be interesting while presenting some familiar elements from other games. The Primary Wager is also crafted, in addition, to provide a carefully calculated house advantage. This allows the game to be suited for use as a Casino game. It also allows the game to be suited for Player-against-Player cardroom games. Changing some of the rules regarding ties and/or pushes or other rules can allow one of ordinary skill in designing casino games to adjust the house advantage to meet their own particular needs.

SECONDARY WAGERS

Secondary Wagers allow a Player to bet on the raw strength of the five-card dealt hand. For example, in "One Pair Bet" the Player bets that his dealt hand contains at least one pair. There is a "Two Pair Bet," a "Three-of-a-kind Bet," and/or a "Special Bet." These bets are evaluated after the cards are uncovered, and are evaluated independently of the outcome of the Primary Wager. For example, a Player may elect to split a dealt hand three-of-a-kind between the high hand and the low hand for reasons of strategy and this not prevent his Secondary Wagers from winning as three-of-a-kind.

One Pair bet. This Secondary Wager is won if the Player receives a dealt hand (five cards in the preferred embodiment) which is any of the following: One Pair, Two Pair, Three-of-a-Kind, Full House, or Four-of-a-Kind. Any other type of dealt hand is a losing hand. The recommended payout is 1 to 1, except for a pair of deuces (22), where the recommended payout is 1 to 2. This recommended payout yields a House advantage of about 3.04%. One Pair bet is the only Secondary bet that is recommended be allowed for cardroom play.

Two Pair bet. This Secondary Wager is won if the Player receives a dealt hand which is any of the following: Two Pair, Three-of-a-kind, Full House, or Four-of-a-Kind. Any other type of dealt hand is a losing hand. The recommended payout is 18 to 1, which yields a House advantage of about 6.48%.

Three-of-a-kind bet. This Secondary Wager is won if the Player receives a dealt hand which is any of the following: Three-of-a-kind, Full House, or Four-of-a-Kind. Any other type of dealt hand is a losing hand. The recommended payout is 40 to 1, which yields a House advantage of about 6.48%.

Special Side Bet. This Secondary Wager wins if the Player receives a dealt hand which is any of the following: Two pair, Three-of-a-kind, Full House, or Four-of-a-Kind. Any other type of dealt hand is a losing hand. The recommended payout is scaled: two pair at 5 to 1, three-of-a-kind at 10 to 1, full house at 100 to 1, and four-of-a-kind at 1000 to 1. The recommended payouts yield a House advantage of about 9.65%.

The following chart:

| Side Bet | Odds | Player's Dealt Hand |
|---|---|---|
| One Pair | 1-to-1 | Pair of threes or better, 2Pair, 3s, FH, 4s |
| One Pair | 1-to-2 | Pair of deuces |
| Two Pair | 18-to-1 | 2Pair, 3s, FH, 4s |
| Three-of-a-Kind | 40-to 1 | 3s, FH, 4s |
| Special | 5-to-1 | 2Pair (two pair) |
| Special | 10-to-1 | 3s (three-of-a-kind) |
| Special | 100-to-1 | FH (full house) |
| Special | 1000-to-1 | 4s (four-of-a-kind) |

Payout odds are based on a five-card embodiment.

The Secondary Wagers are preferably placed by placers in Secondary Wager circles on the playing surface used for the placement of Players' wagers. Thus the Side Bets are known by the following names: One Pair Circle Bet, Two Pair Circle Bet, Three-of-a-kind Circle Bet, Full House Circle Bet, and S Circle Bet.

Because of the favorable calculated house advantage, Players may make a Primary Wager, one or more Secondary Wagers or a combination of the primary and Secondary Wagers.

Other embodiments of the game include a lower house advantage on the Side Bets coupled with a limit on how much can be bet on the Side Bet in comparison to the Primary Wager. This is done in the table game craps.

According to some house rules, a Player may place an additional wager "behind" their original wager. This wager is placed at odds which do not present a house advantage. For example, a Player may place up to the amount of his original wager that a point of 4 (three combinations to make the point) will be thrown before a point of 7 (six combinations to make the point) with a 2-to-1 payout. In the present invention, forcing Players to make a Primary Wager before they can place any Secondary Wager limits the possibility of a total novice being able to play without resorting to strategy. Such an embodiment, however, might stimulate more "action" at the table.

In the preferred embodiment the Player can limit his bets to Secondary Wagers without having to place a Primary Wager.

Other Side Bets can be created, in accordance with the card game of the present invention, by one of ordinary skill in the art of creating card games. This includes the creation of new Side Bets or adjusting the suggested payout of existing Side Bets. For example, one embodiment allows for Side Bets on straights, flushes, straight flushes, and royal flushes with appropriate payouts calculated to create an appropriate house advantage. However such an additional Side Bet would slightly complicate the clean look of the game table as contemplated in many of the preferred embodiments.

In the preferred embodiment of the game of the present invention, a traditional poker royal flush is one of the worst possible dealt hands. The Primary Wager is an almost guaranteed loser. The dealt hand gets split for a high hand of "point" 1 and a low hand of "plain point" 0. AJ10 and KQ. A One Pair Side Bet for such a hand would be a loser as well.

In the preferred embodiment for cardroom play, there are no Secondary Wagers. A Banker will not want to pay a potential 18-to-1 payout of the Two Pair Side Bet or the devastating 1000-to-1 payout for four-of-a-kind on the worst case scenario Special Side Bet. It would be an embodiment in accordance with the present invention, however, which allowed One Pair Side Bets in cardrooom games, since there is a 1-to-1 payout involved.

PRIMARY WAGER STRATEGY AND THE "HOUSE WAY"

The House Way is designed for a five-card embodiment.

A Player (or Banker) has choices in how to split up the five cards dealt hand. Assume a dealt hand: A9764. One split yields a high hand with a "point" 4 and a low hand with a "plain point" 3. The dealt hand is split A+7+6=24 and the remainder 9+4=13. A different split of the same dealt hand lends a more powerful high "point" 9 and a low "point" 8. The dealt hand is split 9+6+4=19 and A+7=18. Players bring strategy to bear in playing their dealt hands in the Primary Wager.

Similarly, it is contemplated that the house will want the Banker to implement certain strategies to preserve the advantages of the house. As a result of careful mathematical analysis, the "house way" was created by the present inventor. A description of the "house way" follows.

1. Four-of-a-kind is declared as four-of-a-kind before the hand is split.
2. Full house is played with three-of-a-kind in the high hand and the pair in the low hand.
3. Three-of-a-kind is placed in the high hand, with the following exceptions:
   (a) Split 222, 333, or 444 if this can give a minimum of low hand 7 and improve at least 4 points in the low hand
   (b) Split 555, 666, or 777 if this can give a minimum of low hand 6 and improve at least 3 points in the low hand
   (c) Split 888 if this can give a minimum of low hand 7 and improve at least 2 points in the low hand
   (d) Split 999 if this can improve at least 2 points in the low hand
   (e) Split 10 10 10, JJJ, QQQ, KKK, or AAA if this can improve at least 1 point in the low hand
4. Two pair is played with high pair in high hand and low pair in low hand.
5. One pair is placed in the high hand, with the following exceptions:
   (a) Split 22, 33, 44, 55, or 77 if this can give a minimum of 8 and improve at least 2 points in the low hand
   (b) Split 66 if this can give a minimum 6 and improve at least 3 points in the low hand and give a 9 in the high hand
   (c) Split 88 if the hand contains three cards from the following set: A K Q J 10.
   (d) Split 99 if the hand contains three cards from the following set: K Q J 10
6. "Point hand"
   (a) Whenever possible, set an A-high 9, K-high 9, or Q-high 9 in the high hand; otherwise set the low hand as high as possible.
   (b) Highest card: whenever the highest card may be put in the low hand as well as in the high hand, put the highest card in the high hand only if the low hand is 0 to 4 (plain point) or if the high hand is a 9.

First example of the House Way strategy: The Banker is dealt AJ662. One dealt hand set is 66J A2. Looking to the House Way guide, we see that a pair of sixes should only be split if it meets three conditions: gives a minimum 6 and improve at least 3 points in the low hand and give a 9 in the high hand. Splitting the cards A62 and J6 meets these conditions, and stands a stronger chance of winning the hand with an Ace-high "point" 9 and a low hand "point" 6 versus a pair and a low hand "plain point" 3.

Second example of the House Way strategy: The Banker is dealt KQJ88. One hand set is 88J KQ which yields a high hand "pair" and a low hand "plain point" 0. Splitting the pair yields 8KJ and 8Q in the best split that is not a foul.

The "house way" strategy yields a "house advantage" of about 1.85%.

THE DEAL

Although up to ten hands can be dealt from a standard fifty-two card deck, the preferred embodiment uses up to eight positions, including a Banker. Cardroom play contemplates eight Player positions, while Casino play contemplates seven Players and a house Banker. Table size, management of Players and their bets, and speed of play are part of the choice of the number eight. Alternatively, lesser or greater numbers than eight are contemplated in accordance with this invention.

It is preferred that eight dealt hands are always dealt, regardless of the actual number of Players, and that some independent random number generation device is used to assign the dealt hands to Players to reduce the likelihood of problems in dealing. In cardroom or casino play, cards are dealt by a house dealer and house personnel handle all bets and passing of money.

In one embodiment, a shaker containing three dice is used by the house dealer to determine which Player gets the first dealt hand of cards. The dice are uncovered and totaled. The count starts with the Banker and continues in a clockwise direction. For example, if a 3, 3, and 3 are rolled, the 9th person in the count, the Banker, will receive the first set of cards, and the Player to his left receives the next set, and so on. At an eight position table, the 1st, 9th, and 17th count would be the Banker, and the 2nd, 10th and 18th the person to his left. Alternately, the 1st count is always the first seat at the table and continues clockwise therefrom.

In another embodiment, a similar procedure is used with a random number generator display replacing the shaker. After dealing, the dealer hits the start button on the random number generator to obtain a number between one and the number of Players playing the game. The person whose number comes up gets the first set of cards.

It is especially helpful in cardroom versions that allow Players to deal that some independent random means be used to assign dealt hands to Players, such as a shaker or other random number generator.

In another embodiment, the Banker receives one dealt hand, and each Player receives one dealt hand, starting from the Player sitting to the left of the dealer, continuing in a clockwise fashion and ending with the dealer. Cards may be dealt five at a time, or preferably, one at a time. Other traditional methods used in poker games may be used for the deal.

It is contemplated that a single person might wish to play more than one hand at a time. Rules established for other multi-hand games should apply, and no person should be allowed to play more than three hands at one time.

TABLES FOR USE IN PLAY

Figure 2:
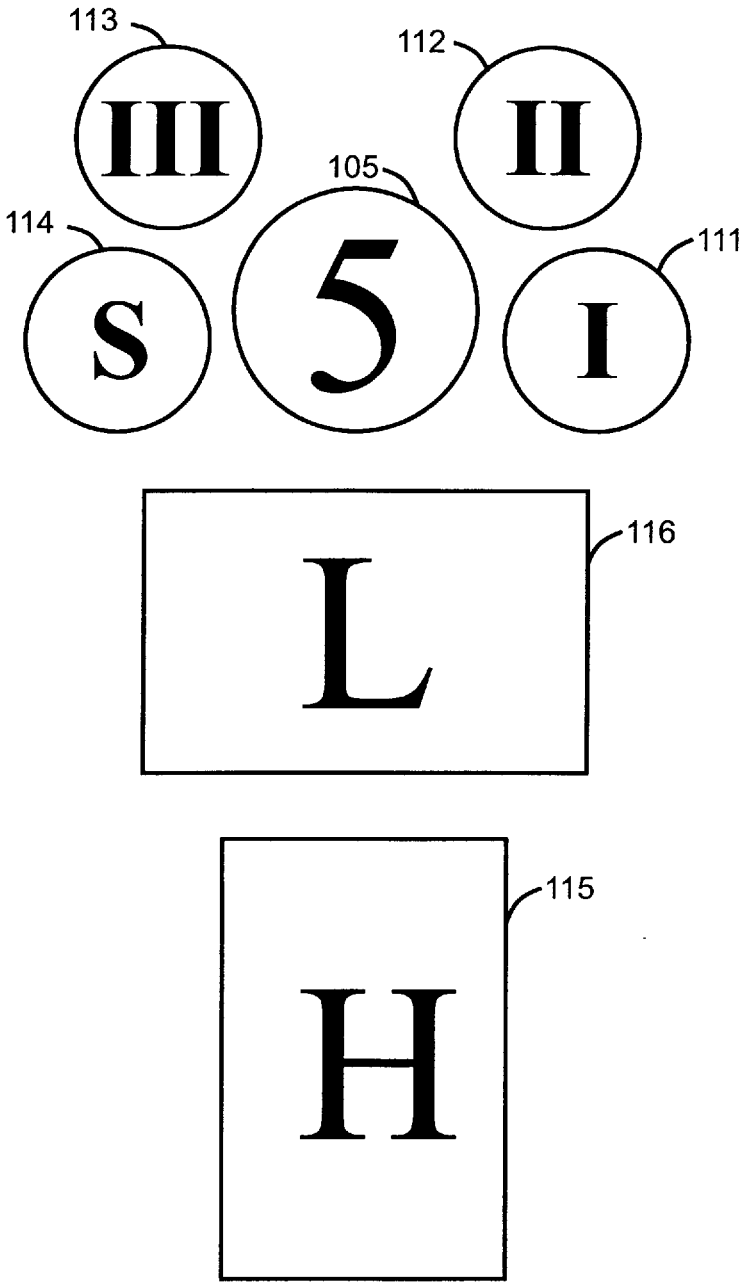
FIG. 2 shows a portion of the layout of the casino card table of FIG. 1.
Figure 3:
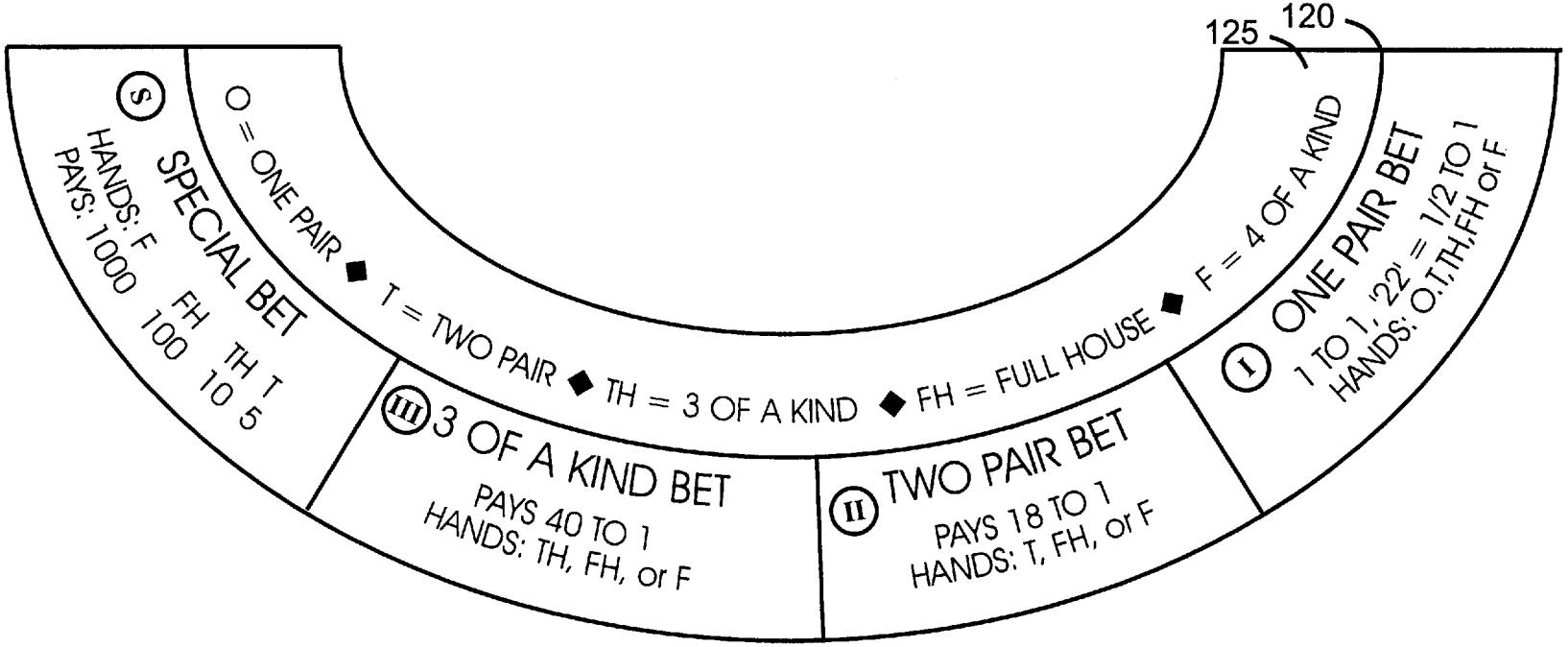
FIG. 3 shows a portion of the layout of the casino card table of FIG. 1.

Play may be facilitated by using tables configured and marked as shown in FIGS. 1 through 5. Referring now to FIGS. 1, 2, and 3, they show a casino playing surface 101. A Player first places any Primary Wager in the Primary Wager area 105, and any Secondary Wager in a Secondary Wager area 110. A Player may place a bet in the Single Pair wager area 111, the Two Pair wager area 112, the Three-of-a-kind wager area 113, or the Special wager area 114. When a Player sets his hand into a high hand and a low hand, the high hand is placed in the high hand area 115 and the low hand is placed in the low hand area 116. Also seen on this embodiment of a casino table for use with the game of the present invention is an odds chart 120 which has a key 125.

Figure 4:
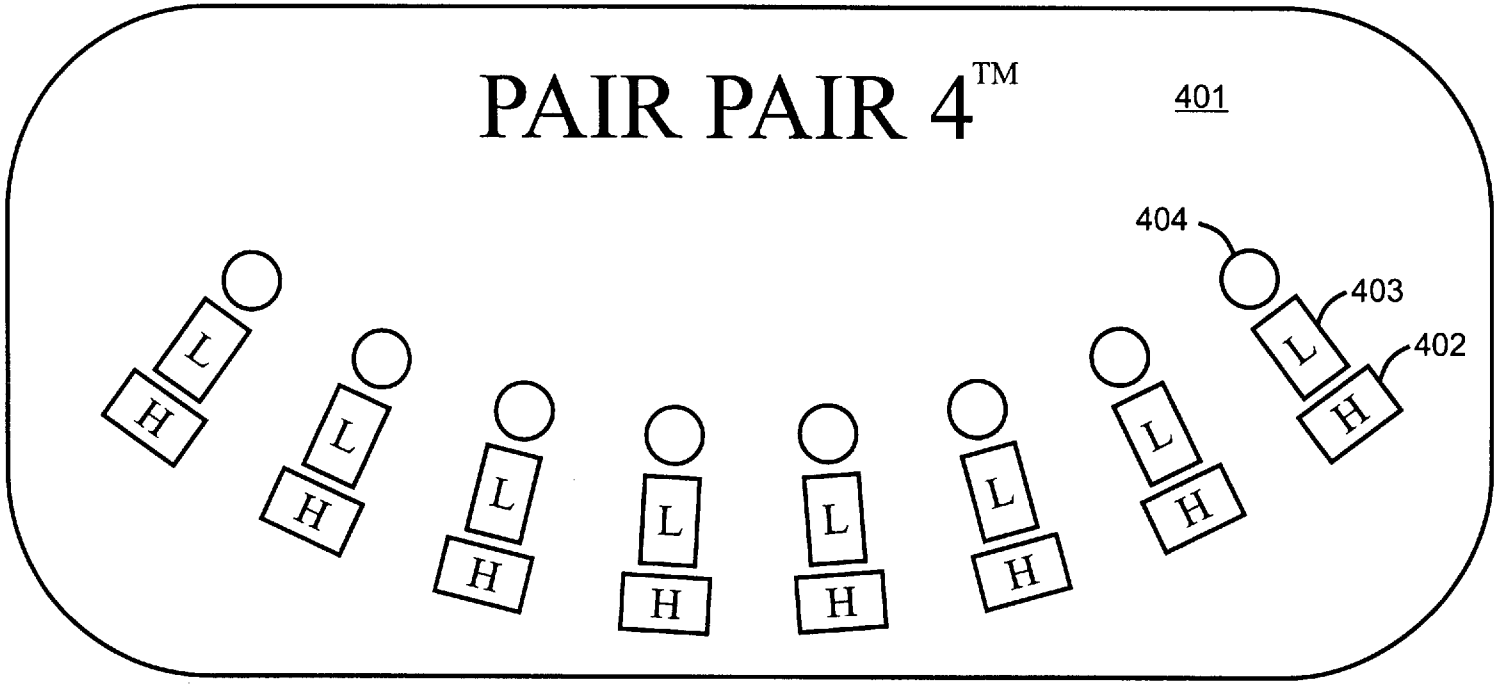
FIG. 4 shows a layout of a cardroom card table of the present invention.
Figure 5:
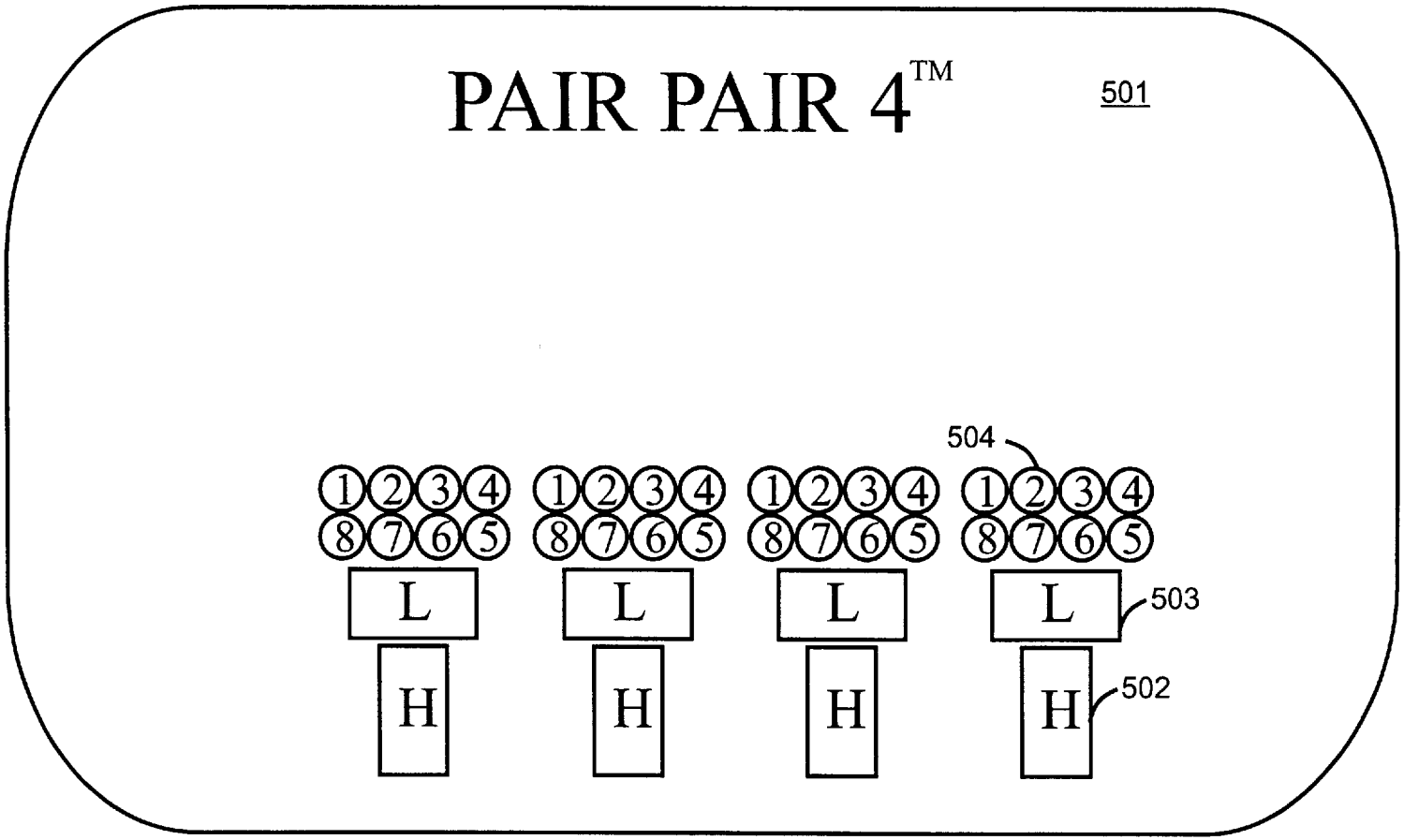
FIG. 5 shows an alternative layout of a cardroom card table of the present invention.

As discussed, the game of the present invention may be played in a cardroom setting. Referring now to FIG. 4, a playing surface 401 is provided with a high hand area 402, a low hand area 403, and a Primary Wager circle 404. This cardroom set-up contemplates a house percentage of winnings or time-paid arrangement. Referring now to FIG. 5, some cardroom conventions provide a playing surface 501 which has standard high hand area 502 and low hand area 503, but a segmented Primary Wager area 504. In this type of cardroom, a Player must pay a $1 fee for each $100 of the Primary Wager (or portion thereof) or other similar arrangement to compensate the house.

Other appropriate playing surfaces may be used in connection with the card game of the present invention.

Referring now to FIG. 6, a "House Way" chart 601 may be published to house casino dealers and Players alike to assist them with strategy.

Wagers are placed with money or chips representing money or other means used in the art.

FOUR-CARD VERSION OF THE PRESENT INVENTION

An alternative but non-preferred embodiment of the present invention uses four cards instead of five. This version also has a Primary Wager and a Secondary Wager as in the five-card variants.

In this four-card game, four-of-a-kind is an automatic winner of the Primary Wager for the Player, and four-of-a-kind for the Banker beats all but a four-of-a-kind hand for a Player. As in the five-card embodiment, in order for the Player to win, the Player's high hand must beat the Banker's high hand, and the Player's low hand must beat the Banker's low hand.

In the four-card variant, the ranking of hands is simplified because there is no three-of-a-kind high hand. Pairs beat hands that have no pairs. Higher ranked pairs beat lower ranked pairs. A same ranked pair results in a loss for the Player and a win for the Banker. The copy rules are the same as those stated in the five card version. The same highest card comparison results in a loss for the Player, and same plain point also results in a loss for a Player per the previous examples as taught hereinabove. Note that "plain point" comparison is not performed on the high hand.

Side Bets include pair, two pair, three-of-a-kind, and four-of-a-kind. Side Bets do no full house since that necessitates a five card hand. Appropriate payouts may be calculated by one skilled in the art. As in the five-card embodiments, a Player may place a Secondary Wager without being required to place a Primary Wager.

As in the five-card variant, up to eight Players are contemplated for cardroom games, and up to seven Players and a house Banker for casino games. Similar card dealing strategies are contemplated: it is preferred that eight hands are dealt no matter how many Players there are, and that the hands are assigned to Players using a random number generator.

Having thus described the invention, what is claimed is:

1. A method of playing a card game among a Banker and a plurality of Players, each Player wagering against the Banker, the method comprising the following steps:

(a) providing and shuffling one or more conventional decks of 52 cards;

(b) each of said Players placing at least one wager selected from the group consisting of a primary wager and allowed secondary wagers;

(c) dealing cards into enough dealt hands of four or five cards to provide a dealt hand for the Banker and for each Player;

(d) determining which dealt hand is assigned to the Banker and which dealt hand is assigned to each of said Players;

(e) determining if any of the Players has four-of-a-kind, whereupon each Player having four-of-a-kind wins the primary wager;

(f) determining if the Banker has four-of-a-kind, whereupon each Player not having four-of-a-kind loses the primary wager;

(g) each Player that has not either won the primary wager in step (e) or lost the primary wager in step (f) and the Banker setting their dealt hands into a low hand of two cards and a high hand of the remaining cards, the rank of the high hand being no lower than the rank of the low hand;

(h) determining whether each Player wins, loses or ties said Player's primary wager, if any, as follows;

(I) if the Player's low hand beats the Banker's low hand and if the Player's high hand beats the Banker's high hand, determining the Player to be the winner of the primary wager;

(II) if the Player's low hand loses to the Banker's low hand and if the Player's high hand loses to the Banker's high hand, determining the Player to be the loser of the primary wager;

(III) if the Player's low hand loses to the Banker's low hand and if the Player's high hand beats the Banker's high hand, determining the primary wager to be a tie; and (IV) if the Player's low hand beats the Banker's low hand and if the Player's high hand loses to the Banker's high hand, determining the primary wager to be a tie;

(i) determining whether each Player wins, loses or ties each of said Player's secondary wagers, if any, and (j) each Player settling wagers with the Banker;

wherein hands are ranked in descending order as follows:

three-of-a-kind, pair, and point value;

a first hand containing three-of-a-kind beats a second hand containing a lower ranked three-of-a-kind;

a first hand containing a pair beats a second hand containing a lower ranked pair;

a first hand beats a second hand if the first hand is a higher point value than the second hand;

the Banker's hand beats a Player's hand if the hands contain the same pair;

a Banker's low hand beats a Player's low hand if the low hands have the same point value and the point value is between 0 and 4; and a Banker's hand beats a Player's hand if the point value is a tie, and the highest card in each hand are of the same rank and the hand is not a low hand with a point value between 0 and 4.

2. The method of playing a card game according to claim 1, wherein the cards are distributed in eight dealt hands of five cards each.

3. The method of playing a card game according to claim 1, wherein the house is the Banker.

4. The method of playing a card game according to claim 1, wherein the house is neither the Banker nor any of the Players.

5. The method of playing a card game according to claim 1, wherein an allowed secondary bet is a One Pair Side Bet, wherein a Player wins a One Pair Side Bet if the Player's dealt hand is a pair, two pair, three-of-a-kind, full house, or four-of-a-kind.

6. The method of playing a card game according to claim 1, wherein an allowed secondary bet is a Two Pair bet, wherein a Player wins a Two Pair bet if the Player's dealt hand is two pair, three-of-a-kind, full house, or four-of-a-kind.

7. The method of playing a card game according to claim 1, wherein an allowed secondary bet is a Three-of-a-kind bet, wherein a Player wins a Three-of-a-kind bet if the Player's dealt hand is three-of-a-kind, full house, or four-of-a-kind.

8. The method of playing a card game according to claim 1, wherein an allowed secondary bet is a Special Side Bet, wherein a Player wins a Special Side Bet if the Player's dealt hand is two pair, three-of-a-kind, full house, or four-of-a-kind.

9. The method of playing a card game according to claim 1, wherein the number of dealt hands does not exceed the number of Players at the table plus the Banker.

10. The method of playing a card game according to claim 1, wherein the step (d) of determining which dealt hand is assigned to the Banker and which dealt hand is assigned to each of said Players comprises the following substeps:

(i) randomly generating a numerical total;

(ii) counting to said total a number of Players to the left or right of the Banker starting with the Banker and giving that Player the first dealt hand; and (iii) successively assigning the rest of the dealt hands to the other Players in order of their respective positions, in a clockwise or counterclockwise direction.

11. The method of playing a card game according to claim 10, wherein said numerical total is randomly generated by rolling dice.

12. The method of playing a card game according to claim 1, wherein secondary wagers are settled according to the following chart:

| | | |
|---|---|---|
| One Pair | 1-to-1 | Pair of Threes or better, 2Pair, 3s, FH, or 4s |
| One Pair | 1-to-2 | Pair of Deuces |
| Two Pair | 18-to-1 | 2Pair, 3s, FH, or 4s |
| Three-of-a-Kind | 40-to 1 | 3s, FH, or 4s |
| Special | 5-to-1 | 2Pair (two pair) |
| Special | 10-to-1 | 3s (three of a kind) |
| Special | 100-to-1 | FH (full house) |
| Special | 1000-to-1 | 4s (four of a kind) |

13. The method of playing a card game according to claim 1, wherein a single deck of cards is provided and shuffled in step (a).

14. The method of playing a card game according to claim 1, further comprising an initial step of providing a playing surface marked and configured to facilitate the setting of hands and the placing of wagers.

15. The method of playing a card game according to claim 1, wherein no secondary wagers are allowed.

16. The method of playing a card game according to claim 15, wherein the house is neither the Banker nor any of the Players.

17. A method of playing a card game among a Banker and a plurality of Players, each Player wagering against the Banker, the method comprising the following steps:

(a) providing and shuffling one or more conventional decks of 52 cards;

(b) each of said Players placing at least one wager selected from the group consisting of a primary wager and allowed secondary wagers;

(c) dealing cards into enough dealt hands of only four or only five cards to provide a dealt hand for the Banker and for each Player;

(d) determining which dealt hand is assigned to the Banker and which dealt hand is assigned to each of said Players;

(e) each Player and the Banker setting their dealt hands into a low hand of two cards and a high hand of the remaining cards, the rank of the high hand being no lower than the rank of the low hand;

(f) determining whether each Player wins or loses said Player's primary wager, if any, as follows:

(I) if the Player's low hand beats the Banker's low hand and if the Player's high hand beats the Banker's high hand, determining the Player to be the winner of the primary wager;

(II) if the Player's low hand loses to the Banker's low hand and if the Player's high hand loses to the Banker's high hand, determining the Player to be the loser of the primary wager;

(g) determining whether each Player wins or loses each of said Player's secondary wagers, if any, and (h) each Player settling wagers with the Banker;

wherein, hands are ranked in descending order as follows: three-of-a-kind, pair, and point value;

a first hand containing three-of-a-kind beats a second hand containing a lower ranked three-of-a-kind;

a first hand containing a pair beats a second hand containing a lower ranked pair;

a first hand beats a second hand if the first hand is a higher point value than the second hand.

18. The method of playing a card game according to claim 17, additionally comprising at step (f) determining whether each Player ties the primary wager, as follows:

(III) if the Player's low hand loses to the Banker's low hand and if the Player's high hand beats the Banker's high hand, determining the primary wager to be a tie; and (IV) if the Player's low hand beats the Banker's low hand and if the Player's high hand loses to the Banker's high hand, determining the primary wager to be a tie.

19. The method of playing a card game according to claim 18, wherein:

the Banker's hand beats a Player's hand if the hands contain the same pair;

a Banker's low hand beats a Player's low hand if the low hands have the same point value and the point value is between 0 and 4; and a Banker's hand beats a Player's hand if the point value is a tie, and the highest card in each hand are of the same rank and the hand is not a low hand with a point value between 0 and 4.

20. The method of playing a card game according to claim 17, wherein:

the Banker's hand beats a Player's hand if the hands contain the same pair;

a Banker's low hand beats a Player's low hand if the low hands have the same point value and the point value is between 0 and 4; and a Banker's hand beats a Player's hand if the point value is the same, and the highest card in each hand are of the same rank and the hand is not a low hand with a point value between 0 and 4.

21. A method of playing a card game among a Banker and a plurality of Players, each Player wagering against the Banker, the method comprising the following steps:

(a) providing and shuffling one or more conventional decks of 52 cards;

(b) each of said Players placing at least one wager selected from the group consisting of a primary wager and allowed secondary wagers;

(c) dealing cards into enough dealt hands of four or five cards to provide a dealt hand for the Banker and for each Player;

(d) determining which dealt hand is assigned to the Banker and which dealt hand is assigned to each of said Players;

(e) determining if any of the Players has four-of-a-kind, whereupon each Player having four-of-a-kind wins the primary wager;

(f) determining if the Banker has four-of-a-kind, whereupon each Player not having four-of-a-kind loses the primary wager;

(g) each Player that has not either won the primary wager in step (e) or lost the primary wager in step (f) and the Banker setting their dealt hands into a low hand of two cards and a high hand of the remaining cards, the rank of the high hand being no lower than the rank of the low hand;

(h) determining whether each Player wins or loses said Player's primary wager, if any, as follows;

(I) if the Player's low hand beats the Banker's low hand and if the Player's high hand beats the Banker's high hand, determining the Player to be the winner of the primary wager;

(II) if the Player's low hand loses to the Banker's low hand and if the Player's high hand loses to the Banker's high hand, determining the Player to be the loser of the primary wager;

(i) determining whether each Player wins, loses or ties each of said Player's secondary wagers, if any, and (j) each Player settling wagers with the Banker; wherein hands are ranked in descending order as follows: three-of-a-kind, pair, and point value;

a first hand containing three-of-a-kind beats a second hand containing a lower ranked three-of-a-kind;

a first hand containing a pair beats a second hand containing a lower ranked pair;

a first hand beats a second hand if the first hand is a higher point value than the second hand.

22. The method of playing a card game according to claim 21, wherein:

the Banker's hand beats a Player's hand if the hands contain the same pair;

a Banker's low hand beats a Player's low hand if the low hands have the same point value and the point value is between 0 and 4; and a Banker's hand beats a Player's hand if the point value is the same, and the highest card in each hand are of the same rank and the hand is not a low hand with a point value between 0 and 4.

* * * * *